US009776039B1

(12) United States Patent
Xu

(10) Patent No.: US 9,776,039 B1
(45) Date of Patent: Oct. 3, 2017

(54) INTELLIGENT HOUSEHOLD AIR PURIFICATION CABINET TYPE BODY-BUILDING APPARATUS AND USE METHOD THEREFOR

(71) Applicant: Zhejiang Fu Xin Da Health Technology Co. Ltd.

(72) Inventor: Cui Shui Xu, Xiamen (CN)

(73) Assignee: ZHEJIANG FU XIN DA HEALTH TECHNOLOGY CO., LTD., Qu Zhou, Zhejiang Province (CN)

( * ) Notice: Subject to any disclaimer, the term of this patent is extended or adjusted under 35 U.S.C. 154(b) by 0 days.

(21) Appl. No.: 15/227,152

(22) Filed: Aug. 3, 2016

(51) Int. Cl.
*A63B 24/00* (2006.01)
*A63B 15/02* (2006.01)
(Continued)

(52) U.S. Cl.
CPC ..... *A63B 22/0235* (2013.01); *A63B 21/4035* (2015.10); *A63B 23/03516* (2013.01);
(Continued)

(58) Field of Classification Search
CPC . A63B 21/4035; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 2022/0271; A63B 2022/0278; A63B 23/03516;
(Continued)

(56) References Cited

U.S. PATENT DOCUMENTS 5,683,332 A * 11/1997 Watterson ..... A63B 22/0023 482/51
5,813,947 A * 9/1998 Densmore ..... A63B 22/205 482/51
(Continued)

FOREIGN PATENT DOCUMENTS

CN 203989694 U * 12/2014
CN 204158948 U * 2/2015
(Continued)

*Primary Examiner* — Joshua Lee
(74) *Attorney, Agent, or Firm* — McClure, Qualey & Rodack, LLP

(57) ABSTRACT

The present invention discloses an intelligent household air purification cabinet type body-building apparatus, comprising a box body, a running machine, an air purifier and a power supply. The intelligent household air purification cabinet type body-building apparatus is further provided with an intelligent control system which comprises a controller, a central control computer, a pressure frequency detection device, an audio device, a display device and a signal receiving and transmitting device. A use method of the body-building apparatus comprises five steps of facility unfolding and need setting, environment preparation, body-building process, statistical analysis of body-building completion, and folding. The present invention has the advantages of small occupation space, complementary functions, no need of adding a power supply, supply of body-building environment beneficial to a human body, convenient operation and capability of long-term sustainable improvement.

4 Claims, 1 Drawing Sheet

(51) Int. Cl.

| | |
|---|---|
| ***A63B 22/02*** | (2006.01) |
| ***A63B 21/00*** | (2006.01) |
| ***A63B 23/035*** | (2006.01) |

(52) U.S. Cl.
CPC ..... *A63B 24/0062* (2013.01); *A63B 24/0075* (2013.01); *A63B 24/0087* (2013.01); *A63B 2024/0068* (2013.01); *A63B 2210/50* (2013.01); *A63B 2220/30* (2013.01)

(58) Field of Classification Search
CPC ..... A63B 24/0062; A63B 24/0075; A63B 24/0087; A63B 2024/0068; A63B 2024/221; A63B 2024/50; A63B 2024/52; A63B 2024/54; A63B 2024/56; A63B 2024/58; A63B 2220/30
See application file for complete search history.

(56) References Cited

U.S. PATENT DOCUMENTS

| | | | | |
|---|---|---|---|---|
| 6,224,516 | B1 * | 5/2001 | Disch | A63B 22/02 482/51 |
| 6,520,890 | B2 * | 2/2003 | Hsu | A63B 22/02 482/51 |
| 7,780,578 | B2 * | 8/2010 | Packham | A63B 22/02 482/4 |
| 2003/0104907 | A1 * | 6/2003 | Sankrithi | A63B 22/0235 482/51 |
| 2004/0127335 | A1 * | 7/2004 | Watterson | A63B 22/0235 482/8 |

FOREIGN PATENT DOCUMENTS

| | | | |
|---|---|---|---|
| CN | 204972845 | U * | 1/2016 |
| CN | 205626865 | U * | 10/2016 |

* cited by examiner

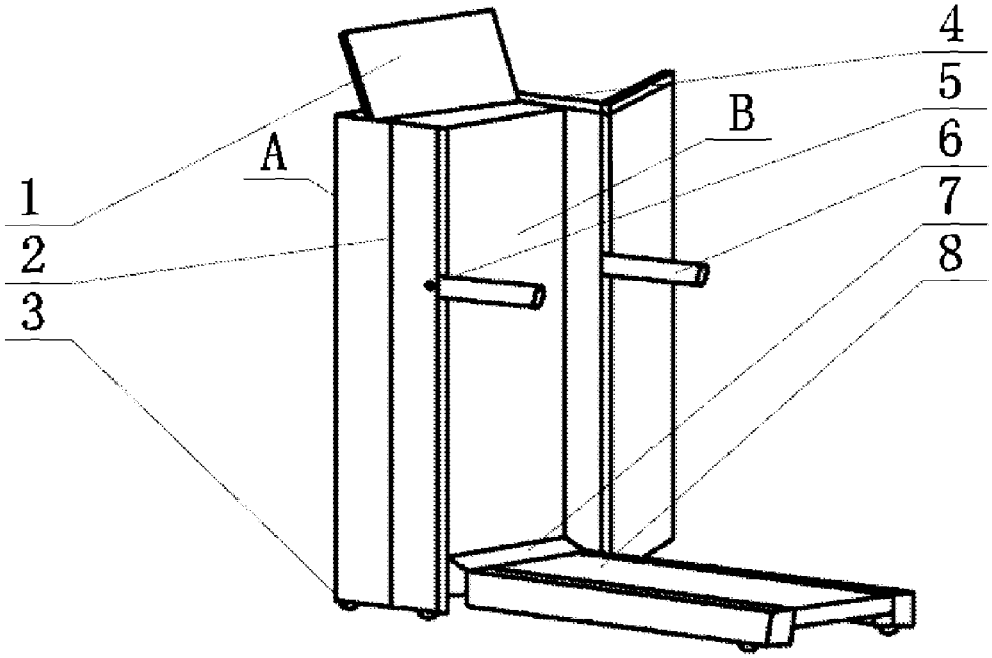
1
2
3
A
B
4
5
6
7
8

INTELLIGENT HOUSEHOLD AIR PURIFICATION CABINET TYPE BODY-BUILDING APPARATUS AND USE METHOD THEREFOR

TECHNICAL FIELD

The present invention relates to the field of body-building apparatuses, and particularly relates to an intelligent household air purification cabinet type body-building apparatus and a use method therefor.

BACKGROUND

A running machine is a permanent body-building apparatus for families and gymnasiums, is the simplest one of body-building apparatuses in today's families, and is the optimal choice of household body-building apparatuses.

An electric running machine is a high-grade apparatus for gymnasiums and families, and drives a running track through a motor to enable people to passively run or walk at different speeds. Because running and walk are formed passively, they are almost the same as ordinary running or walk on the ground seen from profiles of actions, but seen from force exerted by a human body, an extending action is omitted by running and walk on the electric running machine compared with ordinary running and walk. This enables each person walking and running on the electric running machine to feel free and relaxed, ensures that the person can run for about ⅓ distance longer than ordinary running, and increases energy consumption relative to ordinary walk and running. In addition, because electronic auxiliary equipment on the electric running machine has many functions, users can experience different running environments, such as flat ground, uphill slope, hills, variable speed for running, etc., and can make a selection according to exercise purposes.

In applied related patents in China, there is no prior art that integrates an air conditioner and a running machine into a whole. In close fields, the patent "Intelligent Running Machine" (application No.: 201110315937.4 and application date: Feb. 22, 2012) discloses an intelligent running machine. Although an intelligent counting module is integrated, the running machine fails to design space saving or integrate other high-power electrical appliances. Therefore, a larger occupation area is needed and a power supply is required to be additionally arranged. On the other hand, the device is not configured with other facilities complementary with its use functions, and a body-building effect cannot be optimized. Meanwhile, because the device cannot be adjusted and controlled comprehensively, it is inconvenient to use. The patent "Multi-Functional Intelligent Running Machine" (application No.: 201510821060.4 and application date: Jan. 20, 2016) discloses a multi-functional intelligent running machine and provides a running machine capable of interacting with people and performing continuous correction and reminding. However, the multi-functional intelligent running machine has no early warning mechanism or statistical feedback mechanism, and cannot be improved sustainably for a long term. Above two patents cannot provide a body-building environment beneficial to the human body due to lack of complete set of relevant facilities.

SUMMARY

To solve the above defects in the prior art, the present invention is intended to provide an intelligent household air purification cabinet type body-building apparatus and a use method therefor having the advantages of small occupation space, complementary functions, no need of adding a power supply, supply of body-building environment beneficial to a human body, convenient operation and capability of long-term sustainable improvement.

To achieve the above purpose, the present invention adopts the following technical solution: an intelligent household air purification cabinet type body-building apparatus comprises a box body, a running machine, an air purifier and a power supply, wherein rollers are arranged under the box body; the box body is divided into an A side and a B side; the air purifier is arranged on the A side; the running machine is arranged on the B side; the fixed end of the running machine is installed at the bottom of the B side of the box body through a third rotary mechanism; armrests of the running machine are installed in box walls on both sides of the B side of the box body; the fixed ends of the armrests are connected with the box walls through a first rotary mechanism; the intelligent household air purification cabinet type body-building apparatus is further provided with an intelligent control system which comprises a controller, a central control computer, a pressure frequency detection device, an audio device, a display device and a signal receiving and transmitting device which is connected with the running machine, the central control computer, the controller and the above devices, wherein control software that integrates a teaching module, a statistical analysis module and an early warning module is installed in the central control computer; the pressure frequency detection device is installed under a track of the running machine; a monitoring scope at least covers 75% of the horizontal area of the track; the display device is arranged above the top of the box body and is further provided with a gravity induction mechanism; and the display device is installed on the box body through a second rotary mechanism and can be freely rotated and switched on the A side and the B side of the box body.

A use method of the intelligent household air purification cabinet type body-building apparatus comprises the following steps:

1) facility unfolding and need setting

① according to the need of a user, if body building is not needed, the air purifier in the intelligent household air purification cabinet type body-building apparatus can be individually started and the running machine is not started; when body building is needed, a box door of the B side of the intelligent household air purification cabinet type body-building apparatus is opened, the running machine is put down and running parameters are set through the controller;

② after the central control computer receives a signal, details of body-building items counted and analyzed according to the need are displayed through the display device;

③ the user performs fine adjustment according to own need to complete program setting;

2) environment preparation

① after program setting is completed, the air purifier is started and environmental air is kept suitable for body building;

3) body-building process

① after environment preparation is completed, according to a preset program, the central control computer prompts the user to conduct body building step by step through the audio device and the display device;

② during use for the first time for the user, correct use teaching corresponding to the running machine is automatically played on the display device; after the user skillfully applies the running machine, music or video preset by the user is played;

③ the user conducts body building; the pressure frequency detection device detects speed, step pitch and frequency of a body-building action of the user; after receiving the signal, the central control computer conducts statistical analysis; if a difference from a scientific mode is great and a preset threshold in the central control computer is exceeded, the user is subjected to error correction or overworking early warning through the audio device and the display device;

4) statistical analysis of body-building completion

① after body building is completed, the central control computer conducts statistical analysis on related data of the body building; a statistical analysis result is broadcast to the user through the audio device and the display device;

② according to the statistical analysis result, recommendations about next body building are given to the user;

③ when the user completes the next body building, the recommendations are contrasted and the user is corrected and reminded for a long term to scientifically, reasonably and regularly conduct body building;

5) folding of the intelligent household air purification cabinet type body-building apparatus ① the running machine is folded through the third rotary mechanism and the armrests are folded through the first rotary mechanism into the box body; and the box door of the B side of the box body is closed to complete the folding of the intelligent household air purification cabinet type body-building apparatus.

In a preferred embodiment of the above intelligent household air purification cabinet type body-building apparatus, an environmental improvement system is integrated into the air purifier and at least comprises a negative ion generating device, a humidifying device, an oxygenation device and an environmental data monitoring device; and an environmental data monitoring control module is also integrated into the control software in the central control computer.

A use method of a preferred embodiment of the intelligent household air purification cabinet type body-building apparatus is characterized by comprising the following steps:

1) facility unfolding and need setting

① according to the need of the user, if body building is not needed, the air purifier or the environmental improvement system in the intelligent household air purification cabinet type body-building apparatus can be individually or completely started and the running machine is not started; when body building is needed, a box door of the B side of the intelligent household air purification cabinet type body-building apparatus is opened, the running machine is put down and running parameters are set through the controller;

② after the central control computer receives a signal, details of body-building items counted and analyzed according to the need are displayed through the display device;

③ the user performs fine adjustment according to own need to complete program setting;

2) environment preparation

① after program setting is completed, the environmental data monitoring device comes into operation so as to detect environmental temperature, negative ion concentration, oxygen content, air quality and environmental humidity of the intelligent household air purification cabinet type body-building apparatus;

② after the central control computer receives the signal, the environmental data monitoring control module is started to control the air purifier and the environmental improvement system to improve the environment until environmental data suitable for human body motion is reached and is kept;

3) body-building process

① after environment preparation is completed, according to a preset program, the central control computer prompts the user to conduct body building step by step through the audio device and the display device;

② during use for the first time for the user, correct use teaching corresponding to the running machine is automatically played on the display device; after the user skillfully applies the running machine, music or video preset by the user is played;

③ the user conducts body building; the pressure frequency detection device detects speed, step pitch and frequency of a body-building action of the user; after receiving the signal, the central control computer conducts statistical analysis; if a difference from a scientific mode is great and a preset threshold in the central control computer is exceeded, the user is subjected to error correction or overworking early warning through the audio device and the display device;

4) statistical analysis of body-building completion

① after body building is completed, the central control computer conducts statistical analysis on related data of the body building; a statistical analysis result is broadcast to the user through the audio device and the display device;

② according to the statistical analysis result, recommendations about next body building are given to the user;

③ when the user completes the next body building, the recommendations are contrasted and the user is corrected and reminded for a long term to scientifically, reasonably and regularly conduct body building;

5) folding of the intelligent household air purification cabinet type body-building apparatus ① the running machine is folded through the third rotary mechanism and the armrests are folded through the first rotary mechanism into the box body; and the box door of the B side of the box body is closed to complete the folding of the intelligent household air purification cabinet type body-building apparatus.

Compared with the prior art, the present invention has the following advantages: because a household air purifier is a frequently-used electrical household appliance, the installation region for the air purifier and special 16A large jacks and corresponding lines for high-power electrical household appliances are necessarily reserved in a general family; and the present invention integrates the running machine and the air purifier which belong to the high-power electrical household appliances together, thereby having no need of additionally seeking a space for placement or additionally configuring lines and jacks, having small occupation space and no need of additionally configuring a power supply; the present invention can design a high grade and a low grade; in the low grade, basic functions of the air purifier are reserved, and the air purifier is integrated with the running machine to ensure clean environmental air; in the high grade, based on an original air purifier, the environmental improvement system is additionally arranged and has good improvement functions for negative ion concentration, oxygen content and air cleanliness in the air environment; and the functions are complementary with temperature and humidity adjustment functions of the original air purifier; meanwhile, an air conditioner and the environmental improvement system also jointly provide the body-building environment beneficial to the human body and are well matched with the running machine; if the user conducts body building under such environment, the proportion of aerobic exercise in total motion is certainly increased, human comfort is also improved for a long term and the functions of health care, detoxification and cleaning of a cardiorespiratory system can also be performed; because the intelligent control system having complete functions is arranged, a body-building method can be customized in a human-friendly manner; because the pressure frequency monitoring device is arranged, the body-building action can be continuously subjected to error correction and overworking early warning without the condition of injuring the human body or generating a non-ideal body-building effect caused by unscientific body-building actions due to inadequate expertise; because a statistical analysis and feedback mechanism is established, the user can be helped to sustainably improve the matching between the body-building items and the body-building actions for a long term; and the overall functions are complete, complementary, human-friendly, rigorous in structure, efficient and scientific and reasonable in design.

DESCRIPTION OF THE DRAWINGS

FIG. 1 is a structural diagram of the present invention;

In the drawings: display device 1, box body 2, rollers 3, second rotary mechanism 4, first rotary mechanism 5, armrests 6, third rotary mechanism 7 and track 8.

DETAILED DESCRIPTION

An intelligent household air purification cabinet type body-building apparatus comprises a box body 2, a running machine, an air purifier and a power supply, wherein:

the box body 2 is divided into an A side and a B side; the air purifier is arranged on the A side; the running machine is arranged on the B side; rollers 3 are arranged under the box body 2; an environmental improvement system is integrated into the air purifier and at least comprises a negative ion generating device, a humidifying device, an oxygenation device and an environmental data monitoring device; the fixed end of the running machine is installed at the bottom of the B side of the box body 2 through a third rotary mechanism 7; armrests 6 of the running machine are installed in box walls on both sides of the B side of the box body 2; the fixed ends of the armrests 6 are connected with the box walls through a first rotary mechanism 5.

The intelligent household air purification cabinet type body-building apparatus is further provided with an intelligent control system which comprises a controller, a central control computer, a pressure frequency detection device, an audio device, a display device 1 and a signal receiving and transmitting device which is connected with the running machine, the central control computer, the controller, the pressure frequency detection device, the audio device, the display device and the environmental data monitoring device, wherein control software that integrates a teaching module, a statistical analysis module, an early warning module and an environmental data monitoring control module is installed in the central control computer; the pressure frequency detection device is installed under a track 8 of the running machine; a monitoring scope at least covers 75% of the horizontal area of the track 8; the display device 1 is arranged above the top of the box body 2 and is further provided with a gravity induction mechanism; and the display device 1 is installed on the box body 2 through a second rotary mechanism 4 and can be freely rotated and switched on the A side and the B side of the box body 2.

The embodiment is described in a preferred mode, i.e., the environmental improvement system is integrated on the air purifier and the environmental data monitoring control module is integrated into the control software; and a conventional mode of the present invention, i.e., pure integration of the air purifier and the running machine, can be easily obtained from the present embodiment by those ordinary skilled in the art, and will not be repeated.

The central control computer and the display device 1 in the present invention can be separated or integrated, and in the present embodiment, the integration mode is adopted; general tablet personal computers, laptops or all-in-one machines can be used; there is a mature solution for the turnover mode in commercially available deformable laptops and tablet personal computers; and the control software of corresponding version can be installed.

A use method of the above intelligent household air purification cabinet type body-building apparatus comprises the following steps:

1) facility unfolding and need setting

① according to the need of the user, if body building is not needed, the air purifier or the environmental improvement system in the intelligent household air purification cabinet type body-building apparatus can be individually or completely started and the running machine is not started; when body building is needed, a box door of the B side of the intelligent household air purification cabinet type body-building apparatus is opened, the running machine is put down and running parameters are set through the controller;

② after the central control computer receives a signal, details of body-building items counted and analyzed according to the need are displayed through the display device 1;

③ the user performs fine adjustment according to own need to complete program setting;

2) environment preparation

① after program setting is completed, the environmental data monitoring device comes into operation so as to detect environmental temperature, negative ion concentration, oxygen content, air quality and environmental humidity of the intelligent household air purification cabinet type body-building apparatus;

② after the central control computer receives the signal, the environmental data monitoring control module is started to control the air purifier and the environmental improvement system to improve the environment until environmental data suitable for human body motion is reached and is kept;

3) body-building process

① after environment preparation is completed, according to a preset program, the central control computer prompts the user to conduct body building step by step through the audio device and the display device 1;

② during use for the first time for the user, correct use teaching corresponding to the running machine is automatically played on the display device 1; after the user skillfully applies the running machine, music or video preset by the user is played;

③ the user conducts body building; the pressure frequency detection device detects speed, step pitch and frequency of a body-building action of the user; after receiving the signal, the central control computer conducts statistical analysis; if a difference from a scientific mode is great and a preset threshold in the central control computer is exceeded, the user is subjected to error correction or overworking early warning through the audio device and the display device 1;

4) statistical analysis of body-building completion

① after body building is completed, the central control computer conducts statistical analysis on related data of the body building; a statistical analysis result is broadcast to the user through the audio device and the display device 1;

② according to the statistical analysis result, recommendations about next body building are given to the user;

③ when the user completes the next body building, the recommendations are contrasted and the user is corrected and reminded for a long term to scientifically, reasonably and regularly conduct body building;

5) folding of the intelligent household air purification cabinet type body-building apparatus ① the running machine is folded through the third rotary mechanism 7 and the armrests 6 are folded through the first rotary mechanism 5 into the box body 2; and the box door of the B side of the box body 2 is closed to complete the folding of the intelligent household air purification cabinet type body-building apparatus.

The above description of the disclosed embodiments is merely intended to enable those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

The invention claimed is:

1. An intelligent household air purification cabinet type body-building apparatus, comprising a box body (2), a running machine, an air purifier and a power supply, wherein rollers (3) are arranged under the box body (2), and the body-building apparatus is characterized in that:

the box body (2) is divided into an A side and a B side; the air purifier is arranged on the A side; the running machine is arranged on the B side; a fixed end of the running machine is installed at the bottom of the B side of the box body (2) through a third rotary mechanism (7); armrests (6) of the running machine are installed in box walls on both sides of the B side of the box body (2); fixed ends of the armrests (6) are connected with the box walls through a first rotary mechanism (5);

the intelligent household air purification cabinet type body-building apparatus is further provided with an intelligent control system which comprises a controller, a central control computer, a pressure frequency detection device, an audio device, a display device (1) and a signal receiving and transmitting device which is connected with the running machine, the central control computer, the controller and the above devices, wherein control software that integrates a teaching module, a statistical analysis module and an early warning module is installed in the central control computer; the pressure frequency detection device is installed under a track (8) of the running machine; a monitoring scope at least covers 75% of a horizontal area of the track (8); the display device (1) is arranged above the top of the box body (2) and is further provided with a gravity induction mechanism; and the display device (1) is installed on the box body (2) through a second rotary mechanism (4) and can be freely rotated and switched on the A side and the B side of the box body (2).

2. The intelligent household air purification cabinet type body-building apparatus according to claim 1, characterized in that an environmental improvement system is integrated into the air purifier and at least comprises a negative ion generating device, a humidifying device, an oxygenation device and an environmental data monitoring device; and an environmental data monitoring control module is also integrated into the control software in the central control computer.

3. A use method of the intelligent household air purification cabinet type body-building apparatus according to claim 1, characterized by comprising the following steps:

1) facility unfolding and need setting

① according to a need of a user, if body building is not needed, the air purifier in the intelligent household air purification cabinet type body-building apparatus can be individually started when the running machine is not started; when body building is needed, a box door of the B side of the intelligent household air purification cabinet type body-building apparatus is opened, the running machine is put down and running parameters are set through the controller;

② after the central control computer receives a signal, details of body-building items counted and analyzed according to the need are displayed through the display device (1);

③ the user performs fine adjustment according to own need to complete program setting;

2) environment preparation

① after program setting is completed, the air purifier is started and environmental air is kept suitable for body building;

3) body-building process

① after environment preparation is completed, according to a preset program, the central control computer prompts the user to conduct body building step by step through the audio device and the display device (1);

② during use for the first time for the user, correct use teaching corresponding to the running machine is automatically played on the display device (1); after the user skillfully applies the running machine, music or video preset by the user is played;

③ the user conducts body building; the pressure frequency detection device detects speed, step pitch and frequency of a body-building action of the user; after receiving the signal, the central control computer conducts statistical analysis; if a difference from a scientific mode is great and a preset threshold in the central control computer is exceeded, the user is subjected to error correction or overworking early warning through the audio device and the display device (1);

4) statistical analysis of body-building completion

① after body building is completed, the central control computer conducts statistical analysis on related data of the body building; a statistical analysis result is broadcast to the user through the audio device and the display device (1);

② according to the statistical analysis result, recommendations about next body building are given to the user;

③ when the user completes the next body building, the recommendations are contrasted and the user is corrected and reminded for a long term to scientifically, reasonably and regularly conduct body building;

5) folding of the intelligent household air purification cabinet type body-building apparatus ① the running machine is folded through the third rotary mechanism (7) and the armrests (6) are folded through the first rotary mechanism (5) into the box body (2); and the box door of the B side of the box body (2) is closed to complete the folding of the intelligent household air purification cabinet type body-building apparatus.

4. The use method of the intelligent household air purification cabinet type body-building apparatus according to claim 2, characterized by comprising the following steps:

1) facility unfolding and need setting

① according to a need of the user, if body building is not needed, the air purifier or the environmental improvement system in the intelligent household air purification cabinet type body-building apparatus can be individually or completely started when the running machine is not started;

when body building is needed, a box door of the B side of the intelligent household air purification cabinet type body-building apparatus is opened, the running machine is put down and running parameters are set through the controller;

② after the central control computer receives a signal, details of body-building items counted and analyzed according to the need are displayed through the display device (1);

③ the user performs fine adjustment according to own need to complete program setting;

2) environment preparation

① after program setting is completed, the environmental data monitoring device comes into operation so as to detect environmental temperature, negative ion concentration, oxygen content, air quality and environmental humidity of the intelligent household air purification cabinet type body-building apparatus;

② after the central control computer receives the signal, the environmental data monitoring control module is started to control the air purifier and the environmental improvement system to improve the environment until environmental data suitable for human body motion is reached and is kept;

3) body-building process

① after environment preparation is completed, according to a preset program, the central control computer prompts the user to conduct body building step by step through the audio device and the display device (1);

② during use for the first time for the user, correct use teaching corresponding to the running machine is automatically played on the display device (1); after the user skillfully applies the running machine, music or video preset by the user is played;

③ the user conducts body building; the pressure frequency detection device detects speed, step pitch and frequency of a body-building action of the user; after receiving the signal, the central control computer conducts statistical analysis; if a difference from a scientific mode is great and a preset threshold in the central control computer is exceeded, the user is subjected to error correction or overworking early warning through the audio device and the display device (1);

4) statistical analysis of body-building completion

① after body building is completed, the central control computer conducts statistical analysis on related data of the body building; a statistical analysis result is broadcast to the user through the audio device and the display device (1);

② according to the statistical analysis result, recommendations about next body building are given to the user;

③ when the user completes the next body building, the recommendations are contrasted and the user is corrected and reminded for a long term to scientifically, reasonably and regularly conduct body building;

5) folding of the intelligent household air purification cabinet type body-building apparatus ① the running machine is folded through the third rotary mechanism (7) and the armrests (6) are folded through the first rotary mechanism (5) into the box body (2); and the box door of the B side of the box body (2) is closed to complete the folding of the intelligent household air purification cabinet type body-building apparatus.

* * * * *